United States Patent [19]

Lindström

[11] Patent Number: 4,638,775

[45] Date of Patent: Jan. 27, 1987

[54] HAND-ACTUATED ENGINE STARTER

[75] Inventor: Fred B. Lindström, Jönköping, Sweden

[73] Assignee: AB Electrolux, Stockholm, Sweden

[21] Appl. No.: 764,016

[22] Filed: Aug. 9, 1985

[30] Foreign Application Priority Data

Aug. 23, 1984 [SE] Sweden ..... 8404205

[51] Int. Cl.[4] ..... F02N 3/00

[52] U.S. Cl. ..... 123/185 G; 123/185 B; 74/7 C; 192/41 S; 192/42

[58] Field of Search ..... 123/179 SE, 185 A, 185 B, 123/185 BA, 185 BB, 185 G; 74/7 C, 6; 192/41 S, 42, 46

[56] References Cited

U.S. PATENT DOCUMENTS

| | | | |
|---|---|---|---|
| 1,415,531 | 5/1922 | Delano | 123/185 G |
| 2,511,908 | 6/1950 | Forbess | 123/185 BA |
| 3,827,307 | 8/1974 | Couchman, Jr. | 123/185 BA |
| 4,479,394 | 10/1984 | Greenwood et al. | 74/6 |

*Primary Examiner*—Andrew M. Dolinar
*Attorney, Agent, or Firm*—Alfred E. Miller

[57] ABSTRACT

A hand starter for an internal combustion engine having an axially displaceable clutch member journalled on a clutch shaft, for co-acting with a fixed clutch member on the engine shaft. The axial movement of the displaceable clutch member, caused by pulling a start rope, is guided by a helical spring wound in a helical groove on the clutch shaft. The outer periphery of the spring is resiliently pressed against friction producing threads of a cylindrical bearing surface of the displaceable clutch member, to exert an axial force against the axially displaceable clutch member.

6 Claims, 3 Drawing Figures

HAND-ACTUATED ENGINE STARTER

Figures 1, 2, 3:
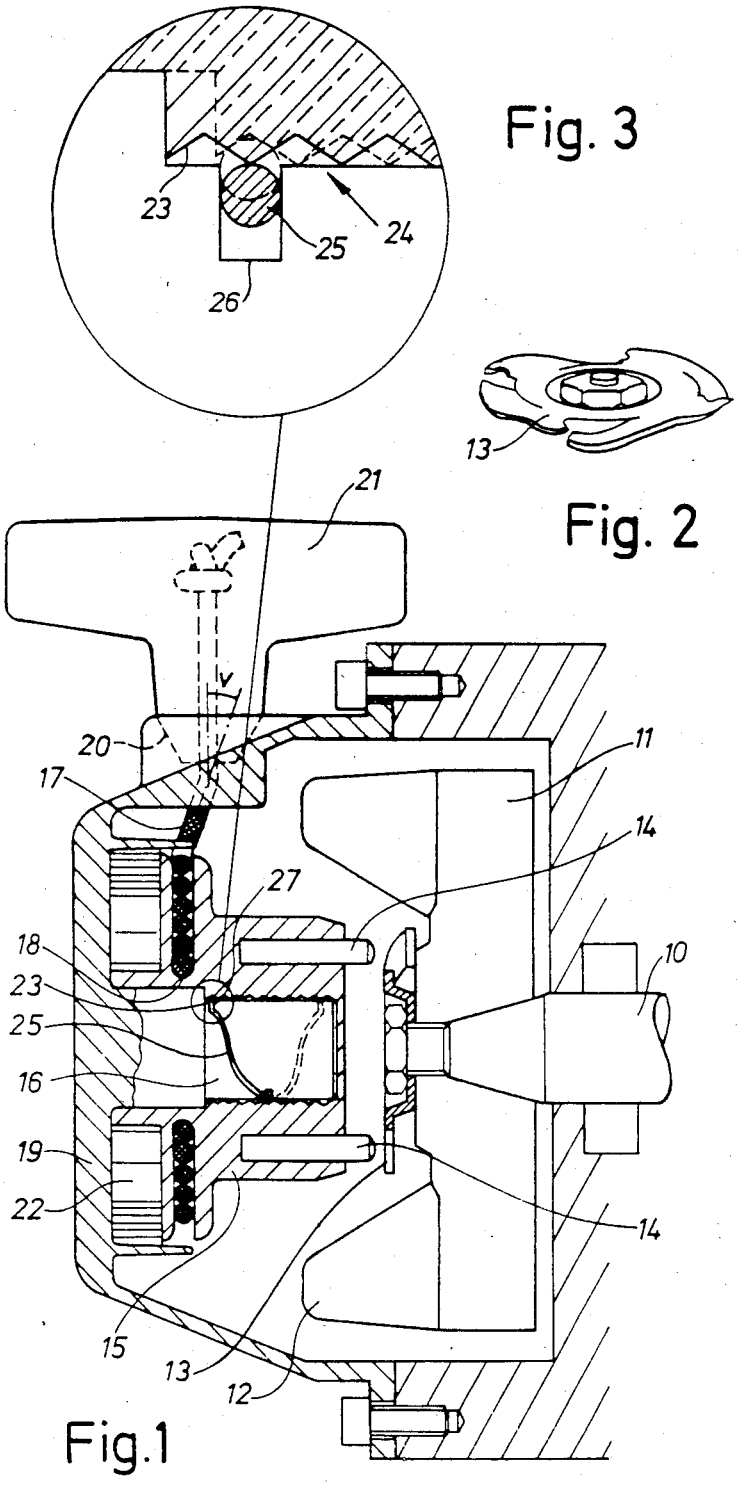

The present invention relates to a starter for an internal combustion engine positioned at the flywheel of the engine and provided with a start rope and a draw handle.

In the prior art of this kind it is well-known to provide a switchable driving clutch member on a shaft and coaxially to this member another clutch member on the engine shaft. Such a clutch is described for example in the Swedish patent specification SE-PS No. 157,325. A starter with such a switchable clutch member comprises usually a plurality of components which are all subjected to tear and wear and successively must be replaced. In order to make such a starter work properly, a friction brake must be provided which, during the switching moment of the driving member, produces a relative movement between the switching members. A portion of the available starting force will then be lost because the force consumed by the brake will not be allotted to the engine. It is therefore important to eliminate the drawbacks of previous starters, i.e. to reduce the tear and wear, simplify the design and decrease the braking force.

In accordance with the invention a starter is provided in which the axial movement of the driving clutch member, which moves when the start rope is pulled, is guided by a helical spring, wound in a helical groove in the shaft and with its outer diameter being pressed by spring action against the cylindrical inner bearing surface of this clutch member, which has friction producing threads or the like, thus exerting an axial force on this member.

In the description of an embodiment of the invention reference is made to the accompanying drawing showing in FIG. 1 a vertical cross section through the starter, in FIG. 2 is a perspective view of the driving plate, and in FIG. 3 a cross-section through the helical groove, spring and thread.

The starter according to FIG. 1 is intended to be used on a small engine, e.g. in a motor saw, a lawn mower or an outboard engine. A motor shaft 10 supports a flywheel 11 which has fan blades 12 and a driving plate 13, shown in detail in FIG. 2. The driving plate is formed by pressing and is shaped to cooperate with connecting pins 14 on a rope pulley 15 journalled on a shaft 16. The rope pulley is brought into rotation when a start rope 17 wound several times in a groove 18 in the pulley is pulled. The shaft 16 is supported by a shield portion 19 with a hole 20 through which the rope extends to a handle 21. The rope pulley is also provided with a return spring 22 of the watch-spring type, the outer end of which is fixed to the shield 19 and the inner end of which is fixed to the rope pulley.

The inner cylindrical bearing surface 23 is provided with threads 24 which co-act with a helical spring 25 positioned in a helical groove 26 in the shaft 16 and having one end fixed therein. As appears in FIG. 3 the groove is deeper than the cross section of the spring so that the latter can sink into the groove. The spring tends to position a portion of its cross section outside the groove in the way shown in FIG. 3. The protruding portion of the cross section will then engage the threads 24 and guide the rope pulley in an axial movement on the shaft 16 when it is rotated. When the rope is pulled this motion is directed to the flywheel, and when the return spring rotates the pulley in the opposite direction the motion is directed from the flywheel. Since the cross section of the thread 24 is triangular and the cross section of the helical spring 25 is circular, the thread slides above the spring (which is then pressed into the groove) when the pulley occupies one of its axial end positions in which it can thus continue rotating. The direction of winding of the spring in relation to the direction of rotation of the pulley is also of importance for the axial force exerted by the spring on the pulley. In the present case the winding direction from the fixing point 27 at the outer end of the shaft is opposite to the rotation occuring when the rope is pulled, i.e. the spring tends to enlarge its diameter thus forcing out into the threads 24. This will cause an increase of the axial force acting on the pulley in the direction to the flywheel, which is advantageous as this force shall immediately on pulling of the rope safely force the pins 14 into the plate 13. On rotation in the other direction (by means of the return spring) the axial force is correspondingly reduced, as the outer diameter of the spring then tends to decrease. On rotation in said other direction the pins are drawn out of the plate when the pulley by means of the return spring rotates to wind up the rope in the groove 18.

In order to reach an immediate engagement at the start, a large pitch of the thread 24 and the of the helical spring 25 is required. The interspace between the threads at the great pitch must be filled up by several threads, and thus the number of thread entrances will be great. With a pitch of 18 mm twelve entrances are necessary in the rope pulley, since the distance between two successive threads is 1,5 mm. In order to further shorten the time of engagement the plate 13 is provided with four recesses for the pins (FIG. 2).

The rope pulley must not disengage with the plate 13 during the start procedure. The angle v of the rope (FIG. 1) shall be such that the rope pulley is not retracted during the start procedure when the helical spring slips off the thread 24.

The helical spring is protected by a shoulder on the shaft 16 and by the cylindrical inner surface 28 of the rope pulley. This means that the substantial portion of the starter, i.e. the helical spring, can work free from pollution and keep the necessary lubricant in place.

The drawing and the description are based on a preferred embodiment. In a modified embodiment the spring may be positioned on the clutch member and the threads on the shaft. Details can of course be changed or replaced without departing from the inventive idea, which is defined in the following claims.

I claim:

1. In a hand-actuated starter for an internal combustion engine wherein a first clutch member is journalled on a first shaft and a second clutch member is mounted on an engine shaft, the first clutch member having a pulley and being axially displaceable with respect to said second clutch member in response to rotation of said pulley, the first shaft and first clutch member having first and second mutually engaging bearing surfaces respectively; the improvement wherein one of said surfaces has threads and the other of said surfaces has a helical groove and a helical spring in said groove positioned to engage said threads, said spring being radially displaceable in said groove.

2. The starter of claim 1 wherein said first clutch member has an interior cylindrical surface defining said second bearing surface, said helical groove being provided on the outer surface of said first shaft.

3. The starter of claim 2 wherein said helical spring has an outer diameter greater than the diameter of said first shaft, one end of said spring being fixed in said groove.

4. The starter of claim 2 wherein said end of said spring is fixed in said groove, and said helical spring is wound from said end in a direction opposite to the direction of rotation of said engine shaft.

5. The starter of claim 1 wherein said threads have the same pitch and direction of threading as said helical groove.

6. The starter of claim 1 wherein the pitch of said threads and groove is substantially greater than the maximum distance between said first and second clutch members.

* * * * *